US005113936A

United States Patent [19]

Sutherland

[11] Patent Number: 5,113,936

[45] Date of Patent: May 19, 1992

[54] WELLHEAD SEAL PROBE

[76] Inventor: James M. Sutherland, P.O. Box 2993, Grand Junction, Colo. 81502

[21] Appl. No.: 695,996

[22] Filed: May 6, 1991

[51] Int. Cl.[5] ..... E21B 23/06; E21B 33/03

[52] U.S. Cl. ..... 166/85; 166/77; 166/84; 166/387

[58] Field of Search ..... 166/85, 84, 77, 387; 175/162

[56] References Cited

U.S. PATENT DOCUMENTS

| | | | |
|---|---|---|---|
| 3,100,015 | 8/1963 | Regan | 166/85 X |
| 4,159,118 | 6/1979 | Jelinek et al. | 277/27 |
| 4,175,475 | 11/1979 | Eckhardt | 92/33 |
| 4,204,690 | 5/1980 | Holland et al. | 272/27 |
| 4,230,325 | 10/1980 | Butler et al. | 277/117 |
| 4,381,868 | 5/1983 | Croy et al. | 277/27 |
| 4,448,424 | 5/1984 | Ernst | 277/30 |
| 5,025,857 | 6/1991 | McLeod | 166/77 |

FOREIGN PATENT DOCUMENTS 1217128 1/1987 Canada .

*Primary Examiner*—Stephen J. Novasad

*Attorney, Agent, or Firm*—Stevens, Davis, Miller & Mosher

[57] ABSTRACT

A tool is disclosed for inserting an oil wellhead isolation device into a well casing. The device includes a mandrel which is threaded on its exterior and which forms a part of a ball nut displacement drive system. The drive nut and its associated mechanical drive components are disposed within a drive housing. The invention presents a novel drive system for the inserting of the mandrel. It provides a simpler and more compact overall structure. Furthermore, the disadvantage is avoided of the jamming encountered in prior art devices operating with a plurality of hydraulic or mechanical displacement devices disposed at a distance from the axis of the mandrel.

6 Claims, 3 Drawing Sheets

WELLHEAD SEAL PROBE

BACKGROUND OF THE INVENTION

The present invention relates to the art of oil wellhead isolation tools and in particular to a device for inserting into the wellhead a mandrel which is typically provided with a wellhead isolation nipple assembly, when a particular wellhead is to be serviced. The seal of the nipple engages the inner wall of the casing of the well so that the flow of gas or oil from the casing passes through the mandrel. Likewise, the mandrel allows the injection of sealing substances through the mandrel into the casing. The upper end of the mandrel is provided with a valve which serves the purpose of selectively opening or closing the passage through the mandrel.

The inserting of the sealing nipple in the casing has so far been accomplished by a mechanism using a series of two or more hydraulic cylinders the cylinder casings of which are fixedly secured to the ends of a transverse beam, usually an upper beam, while the piston rods are secured to the ends of a transverse second, lower beam.

The central part of the upper beam is fixedly secured to the upper end of the mandrel so that, upon contraction of the cylinders at both sides, the upper beam pushes the mandrel into an oil well casing. The hydraulic mechanism replaced previously used purely mechanical devices such as a plurality of rack and pinion devices similarly connected to the respective beams. These devices were complex in structure and bulky. There were problems with the jamming of the device as it was difficult to maintain a permanently balanced operation of several displacement means, each transversely spaced a distance from the axis of the mandrel.

The hydraulic cylinders presented an improvement in that relatively high displacement forces could be generated. However, the overall arrangement is still bulky and the jamming remains a problem.

Accordingly, it is an object of the invention to further advance the art of the wellhead isolation tools by simplifying the structure while at the same time virtually eliminating the possibility of the jamming of the tool during the inserting or withdrawal of the mandrel into and out of the respective casing.

SUMMARY OF THE INVENTION

In general terms, the invention provides an oil wellhead isolation device comprising, in combination:

a) a hollow mandrel having a first end portion adapted to receive a wellhead isolation nipple assembly, and a second end portion fixedly secured to an upper body of the device;

b) mandrel drive means adapted to selectively displace the mandrel relative to said housing, along a longitudinal axis thereof to move the mandrel into or out of an oil well casing;

c) said mandrel drive means including a drive box adapted to be fixedly but removably secured to a respective oil well casing assembly near an upper end of the casing assembly;

d) a displacement nut-and-screw assembly rotatably mounted within said housing in a coaxial arrangement with the mandrel and including an internally threaded sleeve complementary with an outer thread of the mandrel;

e) seal means fixedly secured to said displacement nut assembly for rotation in common with said displacement nut mechanism, said seal means being complementary with said outer thread and being disposed between said displacement nut mechanism and the first end portion of the mandrel; and f) guide means for preventing relative rotation of said housing and said mandrel, while allowing relative axial movement between the two.

BRIEF DESCRIPTION OF THE DRAWINGS

The invention will be described with reference to the accompanying simplified, diagrammatic drawings, wherein.

DETAILED DESCRIPTION

Figure 1:
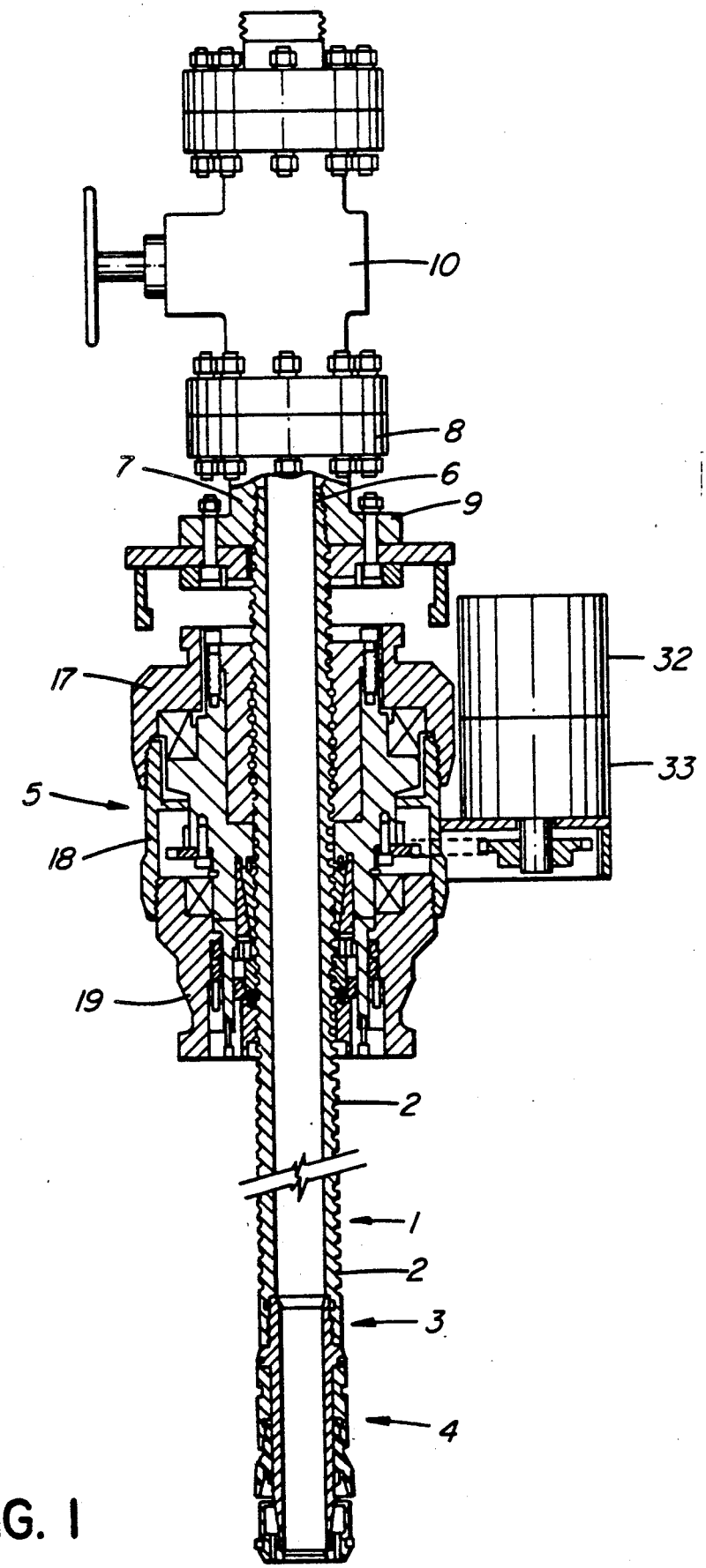
FIG. 1 is an overall view of an oil well isolation tool according to the present invention.

Turning now to the representation of FIG. 1, a hollow mandrel 1 is provided with an external thread 2. Threadably secured to the first end portion 3 of the mandrel is a wellhead isolation nipple assembly 4 which, in the embodiment shown, is the assembly described in greater detail in my co-pening patent application, Ser. No. 567,813, filed Aug. 15, 1990, now U.S. Pat. No. 5,060,723 entitled WELLHEAD ISOLATION TOOL NIPPLE, which is incorporated herein by reference.

The hollow mandrel 1 passes through a drive box 5. Its second end portion 6 is fixedly threaded in an upper body 7 which includes an upper flange 8 and a lower flange 9. The upper flange 8 serves the purpose of connecting the mandrel 1 with a valve 10 adapted to selectively close or open the passage through the mandrel 1.

The lower flange 9 is secured, by way of bolts 11, 12, to a torque disc 13. The lower face of the torque disc 13 is provided with an annular rubber bumper 16. A set of clamps 14, 15 is provided for releasable securement of the parts of the device to each other, as will be described later. The clamps 14, 15 can be of many different types well known in the art of oil exploration. Therefore, it will suffice to say that they are adapted to engage, with their noses 53, the shoulder 53*a* which forms a part of the exterior of the drive box 5.

The drive box 5 is comprised of three principal portions: reference numeral 17 designates a stationary upper housing. It is connected, via a middle housing 18, with a lower housing 19 the exterior of which is provided at its lowermost end, with a shoulder 20 serving the purpose of clamping the lower housing 19 to the upper assembly of the casing of the wellhead to be serviced. The three housings 17, 18, 19 are threaded to each other and are mutually interlocked (the interlocking not shown in the drawings) such that they form a rigid, integral unit.

As already mentioned, the hollow mandrel 1, is threaded into the upper body 7 at 21. Reference numeral 22 denotes a seal at the end of the mandrel 1. Since the upper body has a central passage extending from one end thereof to the other, the mandrel 1 communicates through the upper body 7 with the valve 10.

It will be appreciated from the above that the mandrel 1, the upper body 7, the valve 10, the torque disc 13 and the clamps 14, 15, together with the bumper 16 form an integral unit which moves up and down relative to the housings 17, 18 and 19 as the device is operated.

When the upper body 7 reaches its lowermost position, the clamps 14, 15 are ready to engage the drive housing 5 at its shoulder 53*a*. Upon such connection, the whole assembly of the parts fixedly secured to the mandrel 1, becomes also fixedly secured to the upper housing 17.

The housing 17–18 is provided with two bearings 23, 24 in which a rotary housing 25 is mounted for rotation within and relative to the housing assembly 17, 18, 19. Fixedly secured to the rotary housing 25 is a ball nut 26 which forms one of the main parts of what is generally referred to as a "displacement nut assembly." The ball nut 26 is internally threaded with a thread complementary with the outer thread 2 of the mandrel 1. The ball nut is held in place by a series of cap screws 27 at a location close to the bearing 24. As is well known, the ball nut displacement mechanism is also provided with a series of thrust spheres 45 engaging both the inner thread of nut 26 the outer thread 2 of the mandrel 1. The mechanism of a ball nut displacement drive is well known in general mechanical art and therefore does not have to be described in greater detail.

The rotary housing 25 further comprises a sprocket 28, likewise fixedly secured to the rotary housing 25 by cap screws 29. The sprocket 28 is connected, via a roller chain 30, with a sprocket 31 driven by a hydraulic motor 32 via a reduction gear 33 the latter two being well known in the art and therefore not being shown in detail. Thus, the sprocket 28 can also be referred to as "a driven sprocket", while the sprocket 31 is "a driving sprocket." The drive motor 32 and the reduction gear 33, together with the associated sprocket 31 are mounted in a motor housing 34 which is fixedly secured to the middle housing 18 and thus forms an integral part with the entire housing assembly 17, 18, 19.

At the lower end, the rotary housing 25 is provided with a generally cylindric cutout. The upper end of the cutout houses an inner sealing sleeve 36 made of a suitable material such as Neoprene TM. The inner surface of the sleeve 36 is provided with a thread compatible with the thread of the screw 1. The outer surface of the inner seal or sleeve 36 is frustoconical and is compatible with the frustoconical inner surface of an axially displaceable second or wedging sleeve 37. The lower face of the wedging sleeve 37 is operatively associated with a thrust plate 38 and a preload ring 39. The two elements 38, 29 transmit the action of a piston sleeve 40 to the wedging sleeve 37. By gravity, the piston sleeve 40 normally rests on the upper face of a bushing 41 fixedly secured to and forming an integral part of the rotary housing 35. The bushing 41 is secured to the housing 35, by a series of screws 42. A series of channels 43 communicates the interior of the cylindric cutout 35 with the exterior of the bushing. The outer surface of the lower end of the rotary housing 25, is provided with another set of seals generally designated with reference numeral 43. It provides sealing engagement between the rotary housing 25 and the lower housing 19 at the lower end of the housing 5. The seals 43 are of a known type and therefore are not described in greater detail.

In order to render the apparatus of the present invention operable, it is necessary to prevent relative rotation between the screw or mandrel 1 and the housing assembly 17, 18 and 19 while at the same time allowing axial displacement of the two assemblies.

To this end, a pair of rails 54, 46 are fixedly secured to the medium housing 18 at the exterior thereof. Thus, the two vertical, straight guides 54, 46, each of which is a radially inwardly open channel, are—for all practical purposes—integral with the assembly of the housing 17, 18 and 19 (since the latter housing 17, 18 and 19 are also fixedly secured to each other).

The torque disc 13 carries, at its transversely opposite points, journal means including a pair of radially outwardly projecting axles 47, 48. The axles 47, 48 together with the rails 54 and 46 present a mirror image of each other. It will therefore suffice to describe only one of the two, namely the axle 48 and its associated parts. Reference numeral 49 presents a bushing secured to the axle 48 and rotatably supporting guide wheel 50. The diameter of the guide wheel is only slightly smaller than the inner spacing between the opposed webs of the channel 46. With the arrangement as set forth, the displacement is allowed of the mandrel 1 and its associated parts (including the upper body 7 and valve 10) vertically upwardly or downwardly, i.e. in the direction of the axis 51 of the mandrel 1. By the same token, the tendency of the assembly of mandrel 1, upper body 7 etc. to rotate about the axis 51 is prevented by the engagement of the wheels such as wheel 50 in the respective rails 46, 54. Thus, the driven rotation of the ball nut 26 cannot result in the rotation of the screw 1 even when the clamps 14, 15 are released so that they do not fix the assembly of the screw 1 to the upper housing 17. On the other hand, the axial displacement of the mandrel 1 relative to the housing 5 may take place on rotation of the nut 26.

At the outset of the operation, the mandrel or screw 1 is brought all the way up so that the nipple assembly 4 is now located just below the lower face 52 of the housing assembly 17, 18 and 19. The nipple assembly 4 is then introduced into the upper casing assembly of the well to be serviced. Then, the lower housing 19 is firmly clamped to the upper end of the well casing assembly by clamps not shown, utilizing for this purpose the shoulder 20, as is well known in the art of oil field exploration devices. The lower face 52 of the housing 19 presents an annular surface which is in correspondence with the top surface of the well casing assembly, allowing free rotation of the adjacent bushing 41 and its associated parts rotating in common with the rotary housing 25 as mentioned above.

Figure 2:
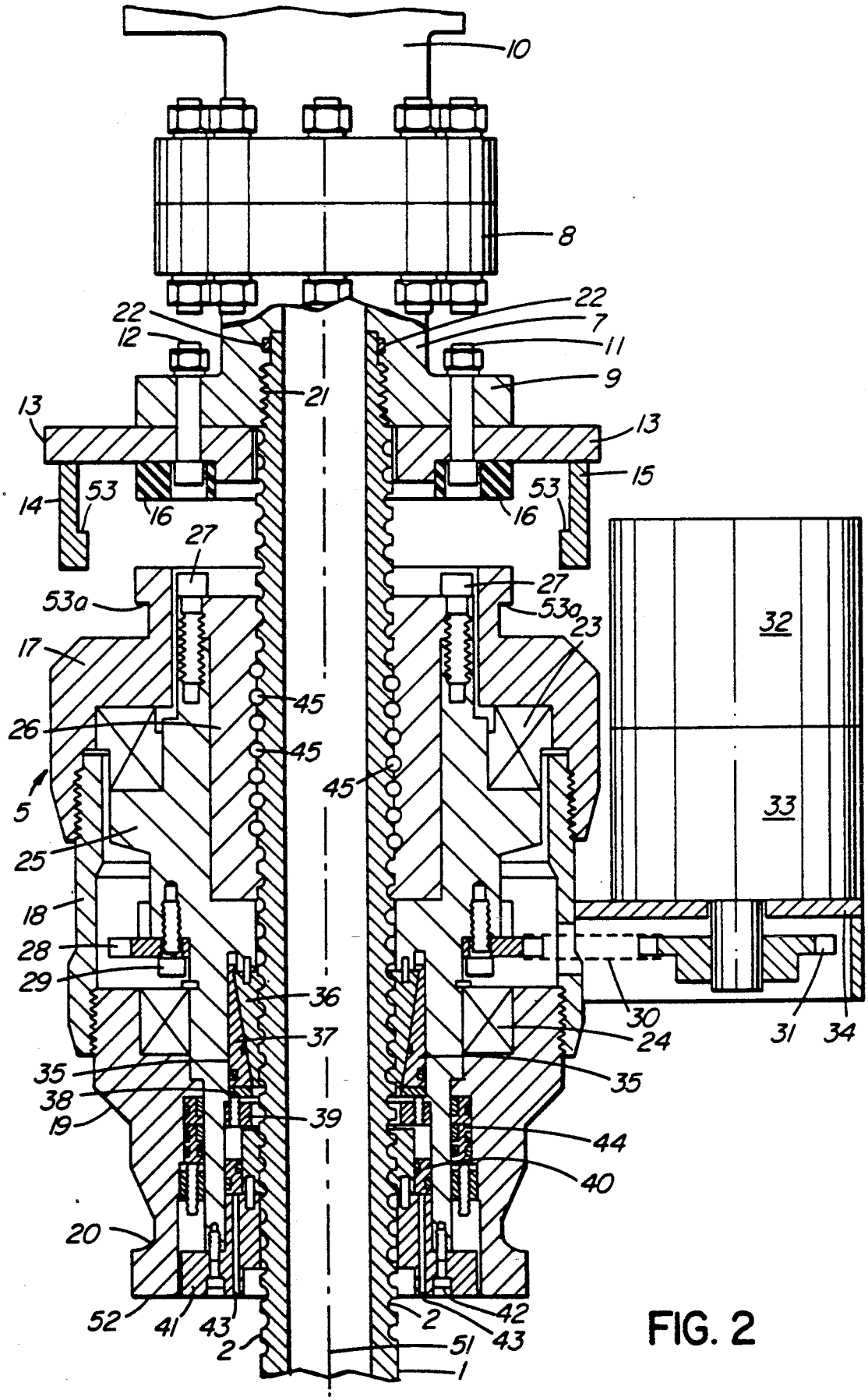
FIG. 2 is a more detailed cross section of the drive means showing the features of the present invention.
Figure 3:
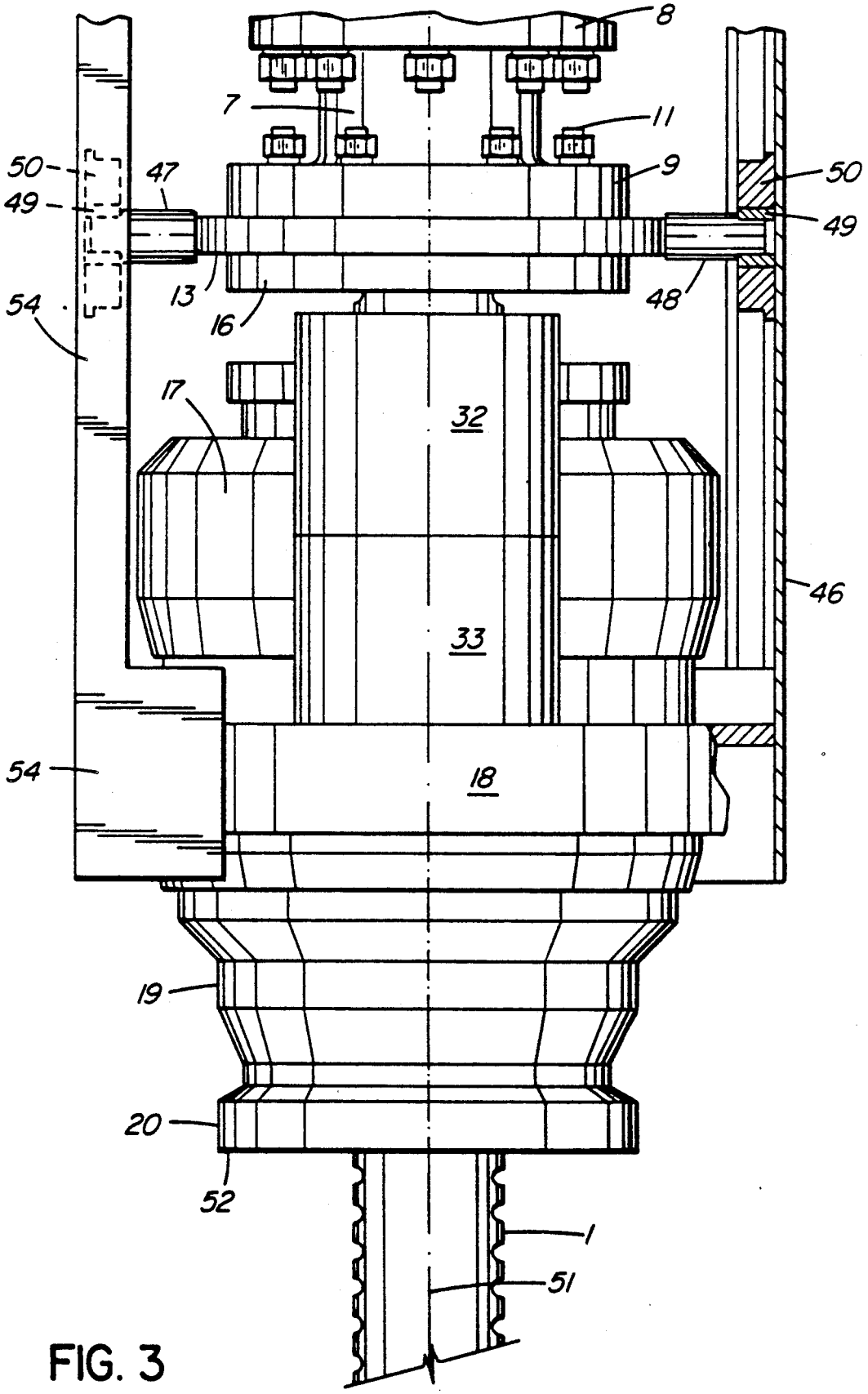
FIG. 3 is a simplified view of the guide system for preventing mutual rotation of the main two parts of the device, with certain parts of the tool omitted for simplicity.

When the housing 19 (and with it housings 18 and 17) is fixedly secured to the well, the motor 32 is actuated to drive the entire set of the rotary housing 25, via the reduction gear 33, sprocket 31, chain 30 and sprocket 28. Since the ball nut 26 is fixedly secured to the rotary housing 25, it now also rotates and its rotation results in the rolling of the thrust balls 45 disposed between the threads of the ball nut 26 and the screw 1. This results in a displacement of the mandrel 1 downwardly, introducing the nipple assembly 4 through the top assembly of the well casing and into the casing itself until the upper body 7 of the device and with it the valve 10, torque disc 13 and the clamps 14, 15 reach the position slightly below that shown in FIG. 2. The clamps 14, 15 can now engage the shoulders 53*a* to fixedly secure the entire device into a single rigid unit which, in turn, is fixedly secured to the oil well casing. The servicing can now be started by manipulating the valve 10 or by proceeding with other required operations. The communication of the well casing with the exterior of the well is now entirely through the valve 10.

When the servicing is completed, the operation is reversed. The clamps 14, 15 are first released whereupon the motor 32 is actuated to raise the mandrel 1. The mandrel 1, is prevented from rotating about the axis 51 of the mandrel due to the rolling of the side wheels such as wheel 50 in the straight guide rails 46, 54.

It may happen that during the operation of the device, i.e. during the movement of the mandrel through the housing assembly, an extremely high pressure is encountered at the nipple assembly 4 pushing the mandrel 1 axially upwardly. This may have the consequence of the reversal of the operation of the ball nut whereby the axial displacement of the screw 1 would in fact tend to cause the rotation of the ball nut 26 which might overcome the torque developed by the motor 32 thus giving rise to a tendency of the motor 32 beginning a planetary motion about axis 51. This tendency is likewise effectively prevented by the pair of rails 54, 46 and the associated guide wheels.

The present invention has been described by way of a preferred embodiment. This is not to say that other embodiments cannot exist which would deviate to a greater or a lesser degree from the details of the structure as described. For instance, the number of the guide rails 54, 46 and the associated mechanism are optional. Even though, at least theoretically, another displacement nut-and-screw assembly could be utilized, the ball nut arrangement is preferred as it presents a frictionless engagement between the crucial parts of the device. The structural arrangement of the housing may differ from that shown. These and many other modifications of the device would still fall within the scope of the present invention. Accordingly, I wish to protect by letters patent document which may issue on this application all such embodiments which properly fall within the scope of my contribution to the art.

I claim:

1. An oil wellhead isolation device comprising, in combination:

a) a hollow mandrel having a first end portion adapted to receive a wellhead isolation nipple assembly, and a second end portion fixedly secured to an upper body of the device;

b) mandrel drive means adapted to selectively displace the mandrel relative to said housing, along a longitudinal axis thereof to move the mandrel into or out of an oil well casing;

c) said mandrel drive means including a drive box adapted to be fixedly but removably secured to a respective oil well casing assembly near an upper end of the casing assembly;

d) a displacement nut-and-screw assembly rotatably mounted within said housing in a coaxial arrangement with the mandrel and including an internally threaded sleeve complementary with an outer thread of the mandrel;

e) seal means fixedly secured to said displacement nut assembly for rotation in common with said displacement nut mechanism, said seal means being complementary with said outer thread and being disposed between said displacement nut mechanism and the first end portion of the mandrel; and f) guide means for preventing relative rotation of said housing and said mandrel, while allowing relative axial movement between the two.

2. The oil well isolation device of claim 1, wherein the internally threaded sleeve and the outer thread of the mandrel are mutually compatible threads of a ball nut mechanism.

3. The oil well isolation device of claim 2, wherein said seal means includes a pair of interengaged sleeves comprised of an inner seal sleeve and a wedging outer sleeve, said inner sleeve having an inner surface provided with a thread compatible with and sealingly engaging the outer thread of the mandrel, the outer surface of the inner sleeve being conical and being in engagement with conical inner surface of the outer sleeve; said outer sleeve being axially displaceable to exert a radially inwardly directed wedging force upon the inner sleeve, to thus increase the force of the sealing contact between the inner sleeve and the outer thread of the mandrel.

4. The oil well isolation device of claim 2, wherein the mandrel drive means includes a mechanical drive of said displacement nut.

5. The device of claim 4, wherein the mechanical drive of the displacement nut is a chain-and-sprocket drive including a driven sprocket coaxial with and fixedly secured to the displacement nut.

6. The device of claim 1, wherein the guide means includes a pair of opposed guide rails generally parallel with the axis of the hollow mandrel and extending to both sides of said housing and fixedly secured thereto; the rails being each engaged with a roller member rotatable about journal means, the journal means being fixedly secured to said upper body.

* * * * *